United States Patent [19]

Egli et al.

[11] Patent Number: 4,768,152

[45] Date of Patent: Aug. 30, 1988

[54] OIL WELL BORE HOLE SURVEYING BY KINEMATIC NAVIGATION

[75] Inventors: Werner H. Egli, Minneapolis; Lawrence C. Vallot, Shoreview, both of Minn.

[73] Assignee: Honeywell, Inc., Minneapolis, Minn.

[21] Appl. No.: 831,982

[22] Filed: Feb. 21, 1986

[51] Int. Cl.[4] ..... E21B 47/022

[52] U.S. Cl. ..... 364/422; 33/304; 33/313

[58] Field of Search ..... 33/304, 313, 302, 359; 364/422

[56] References Cited

U.S. PATENT DOCUMENTS

| | | | |
|---|---|---|---|
| 3,279,086 | 8/1963 | Schlitt et al. . | |
| 3,463,909 | 8/1969 | Weiss . | |
| 3,559,713 | 12/1969 | Ott et al. | 33/304 |
| 3,611,581 | 10/1971 | Butler et al. . | |
| 3,753,296 | 8/1973 | Van Steenwyk . | |
| 3,791,043 | 2/1974 | Russell . | |
| 3,805,398 | 4/1974 | Russell et al. . | |
| 3,808,697 | 5/1974 | Hall . | |
| 3,862,499 | 1/1975 | Isham et al. . | |
| 3,935,642 | 2/1976 | Russell . | |
| 4,192,077 | 3/1980 | Van Steenwyk et al. . | |
| 4,197,654 | 4/1980 | Van Steenwyk et al. . | |
| 4,199,869 | 4/1980 | Van Steenwyk . | |
| 4,231,252 | 11/1980 | Cherkson . | |
| 4,238,889 | 12/1980 | Barriac | 33/312 |
| 4,244,116 | 1/1981 | Barriac . | |
| 4,265,028 | 5/1981 | Van Steenwyk . | |
| 4,293,046 | 10/1981 | Van Steenwyk . | |
| 4,344,235 | 8/1982 | Flanders . | |
| 4,399,692 | 8/1983 | Hulsing, II et al. | 73/151 |
| 4,459,759 | 7/1984 | Hulsing, II | 33/304 |
| 4,471,533 | 9/1984 | Van Steenwyk | 33/302 |

FOREIGN PATENT DOCUMENTS

| | | | |
|---|---|---|---|
| 0972556 | 8/1975 | Canada | 33/313 |

*Primary Examiner*—Joseph Ruggiero
*Assistant Examiner*—Gail O. Hayes
*Attorney, Agent, or Firm*—Merchant, Gould, Smith, Edell, Welter & Schmidt

[57] ABSTRACT

Apparatus and method for the surveying of bore holes, for example, oil wells and the like, to permit accurate three-dimensional mapping thereof, using a single rate gyroscope and an accelerometer package in an instrumentation pod which is lowered into the bore hole. Signals from the accelerometers and the rate gyroscope plus the increments by which the pod is lowered into the well permit continual calculation of pod attitude and updated of pod position at all depths in the hole.

11 Claims, 3 Drawing Sheets

OIL WELL BORE HOLE SURVEYING BY KINEMATIC NAVIGATION

FIELD OF THE INVENTION

This invention pertains to the field of apparatus and methods for the surveying of bore holes, for example, oil well bore holes, to permit determination and mapping of the exact location of the hole at all levels.

BACKGROUND OF THE PRIOR ART

It is often necessary to survey a bore hole in the earth to determine the exact path or location of the hole at all levels. For example, in the fields of oil and gas drilling and geological testing, it is necessary to correlate formations found at different depths in the bore hole, and to do so it is also necessary to know the spatial coordinates of all points along the bore hole. Since the drill bit typically wanders from a straight vertical path during the drilling of the hole, for bore holes of any appreciable depth the location cannot be predicted without specialized survey apparatus.

Numerous systems have been used in the prior art for providing survey data for bore holes. Generally, an instrumented pod is lowered into the bore hole and readings are taken by instruments within the pod and transmitted by wire or otherwise to the surface. Various types of inclinometers or accelerometers, gyroscopes, magnetic sensors and the like have been used to attempt to measure the inclination and direction, or azimuth, of the bore hole at different levels, so that a map may be made for the bore hole. While such systems have achieved a degree of success, in many cases problems with accuracy, cost of manufacture, and slow, time-consuming operation remain. For example, magnetic sensors, which are used in numerous systems for sensing the direction of the Earth's magnetic field within the bore hole to thereby provide a north reference, are inherently subject to potential errors in this environment. Iron-bearing geologic formations at different depths can cause erroneous readings, and of course the instrument cannot be used in the vicinity of ferrous casings, shafts, or other tools, thus creating special application problems. Accelerometers are potentially accurate and reliable devices, but alone cannot fully determine the spatial location and orientation of the instrument pod. Free directional gyroscopes and gyroscopes having multiple sensing axes have been used, but these are complex and costly, and in some cases have drift or precession problems which must be corrected for. Rate gyroscopes can be somewhat smaller and more reliable, but in the past they have been used together with motors and drive apparatus for rotating the rate gyroscope to thereby serve as a north direction finder. Such drive motors and apparatus add cost and complexity and take up valuable space within the instrument pod.

SUMMARY OF THE INVENTION

To overcome these and other problems existing in the field of bore hole surveying, the present invention provides an improved apparatus and method which is relatively simple in manufacture and use, and which is accurate and reliable.

The present invention provides bore hole survey apparatus which includes a carrier or pod adapted to be lowered down into a bore hole to be surveyed. The carrier includes a rate gyroscope for sensing rotation tion of the pod substantially about the longitudinal axis of the pod, which corresponds to the axis of travel in the bore hole. Accelerometer means are provided for sensing the Earth's gravity vector with respect to the pod. Computational means, preferably at the surface, but possibly at least partially on the pod, receive measurement signals from the rate gyroscope and the accelerometer means, and also from means measuring the path length distance which the pod has been lowered down the bore hole, and from this information continually updates the carrier attitude and position as the pod is lowered in the bore hole.

DETAILED DESCRIPTION OF THE PREFERRED EMBODIMENT

Figure 1:
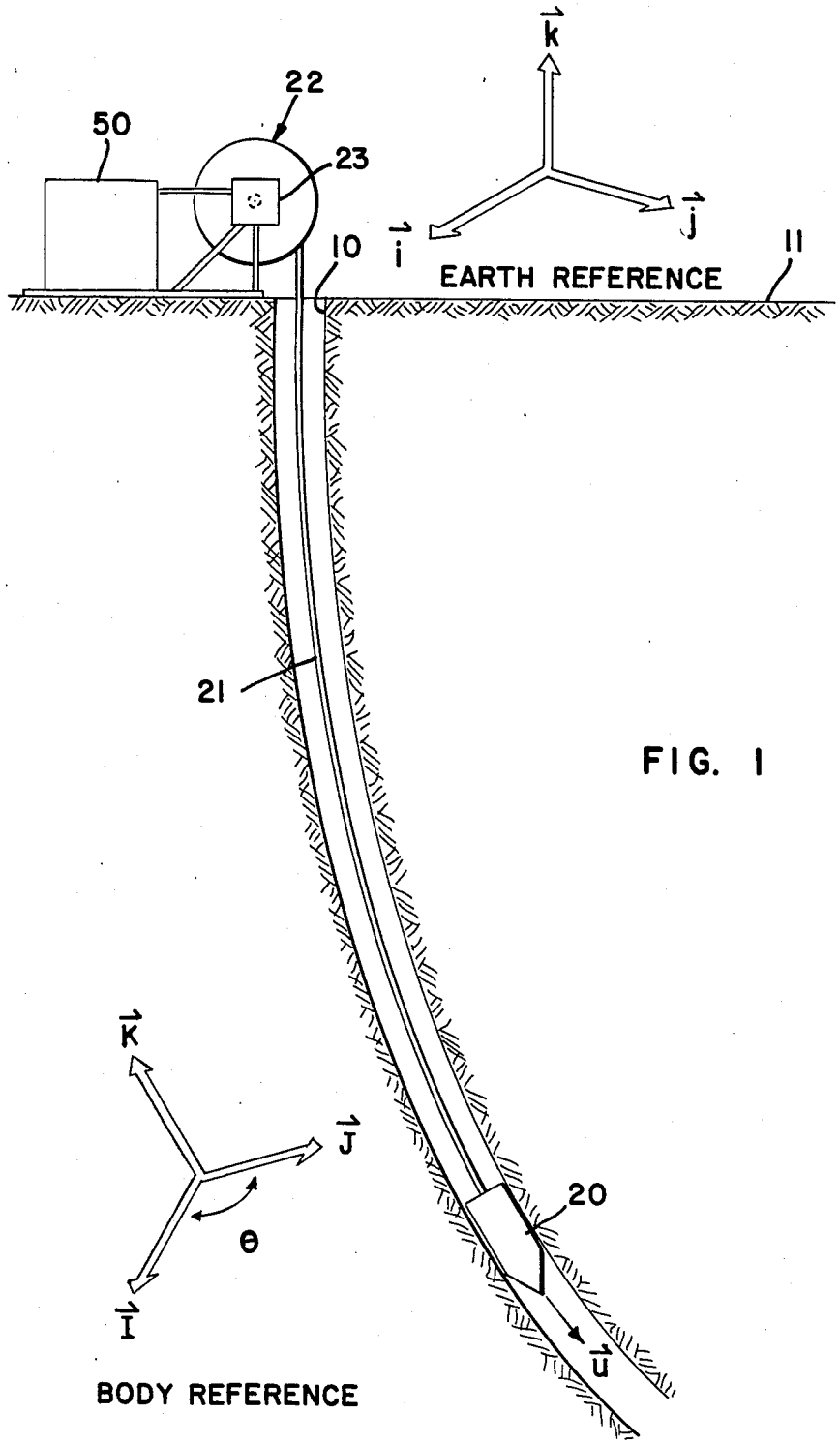
FIG. 1 is a schematic representation of an instrument pod lowered into a bore hole to be surveyed.

In FIG. 1, a bore hole 10 is shown in cross-sectional view extending from the surface 11 some distance into the ground. Bore hole 10 is indicated as being curved since, as pointed out above, the direction of the bore hole in general may wander erratically as the hole is being drilled, and the exact path is not known until it is surveyed. Although a single gentle curve for bore hole 10 is indicated in FIG. 1, it will be appreciated that this is for illustrative purposes only, and in fact bore holes may, and generally do, have multiple changes of direction, so that in general, the bore hole can veer in any direction at any depth.

An instrument pod 20 according to the present invention is shown lowered into the bore hole, being suspended by a cable or wire 21 from a suitable mechanized apparatus 22 which may be used for lowering instrument pod 20 into, and withdrawing it from, the bore hole. Reference number 50 indicates computational apparatus which receives a plurality of types of data from instruments within the pod via suitable wire transmission paths (not shown) associated with cable 21. Computation apparatus 50 also receives data from a device 23 which is in the nature of a cable length odometer, or other measuring apparatus for measuring increments of cable 21 paid out as pod 20 is lowered.

Also shown in FIG. 1 is an Earth reference coordinate system consisting of mutually orthogonal vectors $\vec{i}$, $\vec{j}$ and $\vec{k}$, the latter of which represents vertical. Also shown are mutually perpendicular coordinate vectors $\vec{I}$, $\vec{J}$ and $\vec{K}$, which are the body references for instrument pod 20. u represents the direction of travel of pod 20 as it is lowered, assumed to be axially down the bore hole. Due to the choice of body references, $\vec{u}$ is in the $-\vec{K}$ direction. The angle $\theta$ indicates twist or rotation of instrument pod 20 about its own $\vec{K}$ axis.

At the beginning of a survey, instrument pod 20 is lowered into the top of bore hole 10, and is initialized with its body references $\vec{I}$, $\vec{J}$ and $\vec{K}$ corresponding to the Earth reference $\vec{i}$, $\vec{j}$ and $\vec{k}$. $\vec{i}$ and $\vec{j}$ can be chosen for convenience as $\vec{i}$ being east, $\vec{j}$ being surface north, and $\vec{k}$ being vertically up. It will be appreciated that as the pod is lowered down the bore hole, body references $\vec{I}$, $\vec{J}$ and/or $\vec{K}$ will begin to diverge from the earth reference as the bore hole departs from vertical. In addition, the angle $\theta$ initialized at zero, may take on any value as the pod twists or is rotated about cable 21.

Figure 2:
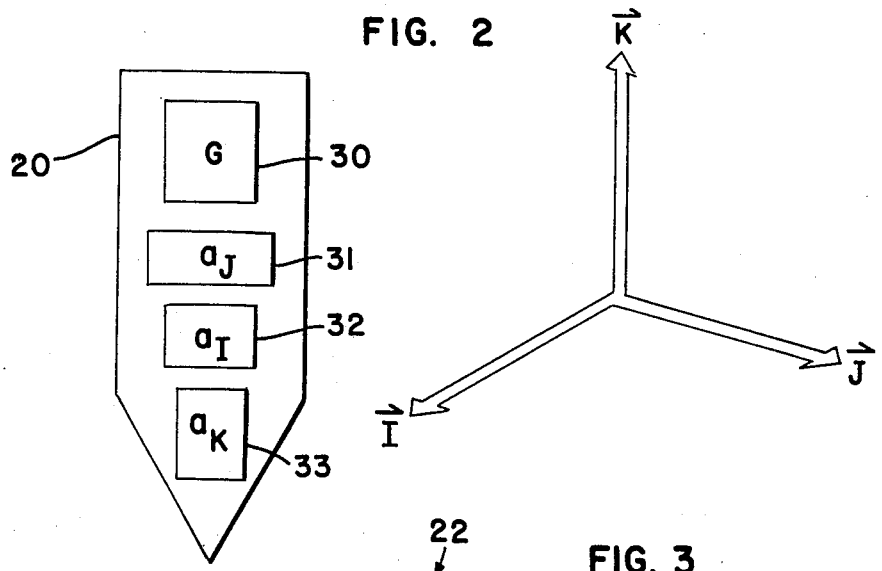
FIG. 2 is a diagram showing the orientation of sensing components within the instrument pod.

Referring now to FIG. 2, instrument pod 20 is shown schematically to include a rate gyroscope 30, and three accelerometers 31, 32 and 33. Rate gyroscope 30 is sensitive to rotation about the $\vec{K}$ axis. Accelerometer 31 is labelled $A_J$ and its sensitive axis is aligned with, and defines, the $\vec{j}$ axis of the pod. Accelerometer 32 is labelled $A_I$ and its sensitive axis is aligned with, and defines, the $\vec{I}$ body axis. Similarly, accelerometer 33 is labelled $A_K$, and has its sensitive axis along the $\vec{K}$ body axis, which is also the longitudinal axis of the pod, along which it is presumed to travel in the bore hole. Rate gyroscopes and accelerometers are well known in the art, and for this reason details of their constructions are not shown. Techniques for mounting such components within a body are also known and are not shown in detail. Also, techniques for providing power to such components, and for transmitting their output signals to the surface, either by wire or other telemetry techniques, will be known to those skilled in the art and are not set forth in detail. It will further be appreciated that while the sensing components 30–33 are indicated as being in the pod and the computational equipment 50 as being at the surface, all or part of the computational equipment can be built into instrument pod 20 through the use of microcircuits and microcomputers as are generally known in the art and in accorance with the principles set forth herein.

Figure 3:
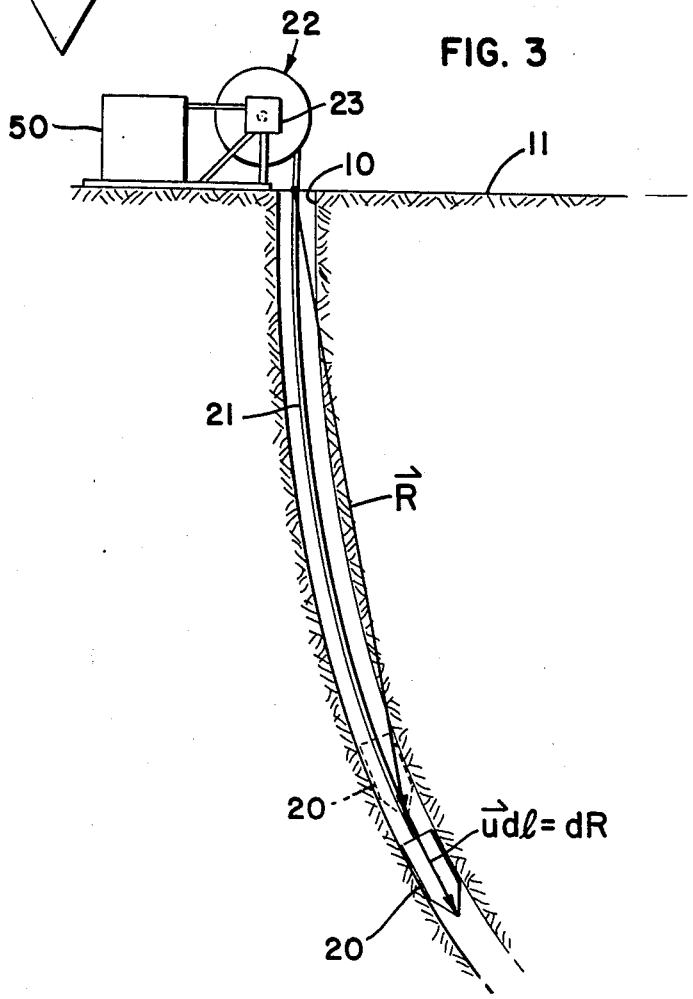
FIG. 3 is a diagram illustrating the method of updating instrument pod position as it is lowered into the bore hole.

The basic methodology for surveying the bore hole is indicated in FIG. 3, and relies on the algorithm:

$$d\vec{R}=\vec{u}\,dl,$$

where $d\vec{R}$=increment of $\vec{R}$;

$\vec{R}$=vector position from initial point;

$\vec{u}$=unit vector pointing in the direction of travel of the navigator pod;

dl=increment of l; and l=length of cable deployed.

The remainder of the algorithms serve to define $\vec{u}$, which is generally varying along the bore hole.

To do this, we define the rotation of the navigator pod, relative to its initial position at the surface. Using simple linear algebra formalisms, we describe the attitude by a rotation matrix, M. This can be considered as a row of column vectors defining the three body axes, $\vec{I}$, $\vec{J}$, and $\vec{K}$, in inertial space:

$$M=\begin{vmatrix} I & J & K \\ \downarrow & \downarrow & \downarrow \end{vmatrix}$$

Conversely, M also comprises a column of row vectors defining the three inertial axes, $\vec{i}$, $\vec{j}$, and $\vec{k}$, as seen in the rotated body frame:

$$M=\begin{vmatrix} i \longrightarrow \\ j \longrightarrow \\ k \longrightarrow \end{vmatrix}$$

For convenience, we define $\vec{i}$, $\vec{j}$, and $\vec{k}$ as being east, surface-north, and vertically up, respectively. We also define navigator pod body axes $\vec{I}$, $\vec{J}$, $\vec{K}$ with $\vec{K}\equiv-u$, and with $\vec{I}$, $\vec{J}$, $\vec{K}$ initialized at $\vec{i}$, $\vec{j}$, $\vec{k}$ respectively.

The mechanization provides rate gyroscope 30 whose input axis is $\vec{K}$, and a set of accelerometers 31, 32, 33. In principle, two accelerometers suffice (since the magnitude of gravity is known, which permits calculation of the third accelerometer), but we may want to use three accelerometers for better accuracy.

Rotation increments, $d\vec{\theta}$, are sensed as follows by the gyroscope and by the accelerometers:

Denote the unit gravity vector, as seen in body axes, by g'. Assume that a small incremental rotation is imparted, represented by the vector $d\theta'$ as seen in body axes coordinates. The effect of $d\theta'$ is twofold. First, it produces a signal in the K-axis gyroscope, due to the component of $d\theta'$ along K', the unit vector K expressed in body axes, i.e.:

$$K'=\begin{bmatrix}0\\0\\1\end{bmatrix}$$

Second, it produces a change in g'. Since $g'=\vec{\vec{M}}g$, where $\vec{\vec{M}}$ is the transpose, and inverse, of M, and where g is the unit gravity vector as seen in the i, j, k reference frame, we have:

$$dg'=d(\vec{\vec{M}}g)=d\vec{\vec{M}}g,$$

since g is a constant [g=−k].

But, $$d\vec{M}=-d\theta'\times\vec{M}$$

(well-known principles of rotation kinematics).

Therefore, $$\begin{aligned} dg' &= -d\Theta'\times\vec{M}g \\ &= -d\Theta'\times g' \end{aligned}$$

So, we solve for $d\theta'$ from:

$$K'\cdot d\theta'=d\theta_{gy}$$

(angle increment seen in K-axis gyroscope)

$$g'\times d\theta'=dg',$$

where dg' is simply the difference between the newest g' vector and its value just prior to the $d\theta'$ rotation. The solution is (bearing in mind that dg' is perpendicular to g'):

$$d\Theta'=\frac{1}{K'\cdot g'}\,[g'd\Theta_{gy}-K'\times dg']$$

(This can be confirmed by verifying that $$d\theta'\cdot K'=d\theta_{gy}$$

and that $$d\theta'\times g'=-dg').$$

Denoting components of g' along the body I, J and K axes by $g'_I$, $g'_J$, and $g'_K$, and of dg' by $dg'_I$, $dg'_J$, and $dg'_K$, we have:

$$d\Theta' = \frac{1}{g'_K}[\vec{g}'d\Theta_{gy} - \vec{J}dg'_I + \vec{I}dg'_J],$$

where I', J', and K' denote unit vectors along the three body axes. In more detail, the components of $d\theta'$ are:

$$d\Theta'_I = \frac{g'_I d\Theta_{gy} + dg'_J}{g'_K}$$

$$d\Theta'_J = \frac{g'_J d\Theta_{gy} - dg'_I}{g'_K}$$

$$d\Theta'_K = d\Theta_{gy}$$

Having $d\theta'$, which is incremental rotation expressed in the body axes, we update the matrix of total rotation, M, by:

$$M = M + dM,$$

where $$dM = M \times d\theta'$$

(well-known principles of rotation kinematics.) From the new M, we get the new updated $\vec{u}$ vector:

$$\vec{u} = -M_3,$$

where $M_3$ is the third column of M. Positional update is given by incrementing $\vec{R}$ by $\vec{u}dl$, where dl is length of cable paid out since last update. The position is then updated by:

$$d\vec{R} = \vec{u}dl,$$

$$\vec{R} = \vec{R} + d\vec{R}$$

where dl is the increment of cable paid out since the last update.

An important detail is that the gyroscope output must be corrected for earth rate. Specifically, we correct $d\theta_{gy}$ thus:

$$d\theta_{gy} = d\theta_{gy}\,\Delta t K \cdot E,$$

where $\Delta t \equiv$ elapsed time since last update, E is Earth rate spin vector:

$$\vec{E} = E(\vec{j}\cos\lambda + \vec{k}\sin\lambda)$$

where $\lambda$ is latitude, $$E = 15.041°/\text{hour},$$

and where K is the body K unit vector expressed in an inertial frame. K is, of course, also equal to $M_3$, the third column of M.

So:

$$d\theta_{gy} = d\theta_{gy} - \Delta t E(M_{23}\cos\lambda \times M_{33}\sin\lambda),$$

where $M_{23}$ and $M_{33}$ are the second and third components of the third column vector of M.

We see some qualifications on the overall concept. Looking at the expression for $d\vec{\theta}$, we see that the computation blows up when $K \cdot g = 0$, i.e., when the bore direction is parallel to the earth surface. This is circumventable by changing the sensing axis of the gyroscope (if there be room to do so in the pod). An interesting variant is to keep the gyroscope axis vertical. This would make the computations simpler in some respects, but involves added hardware complexity.

Figure 4:
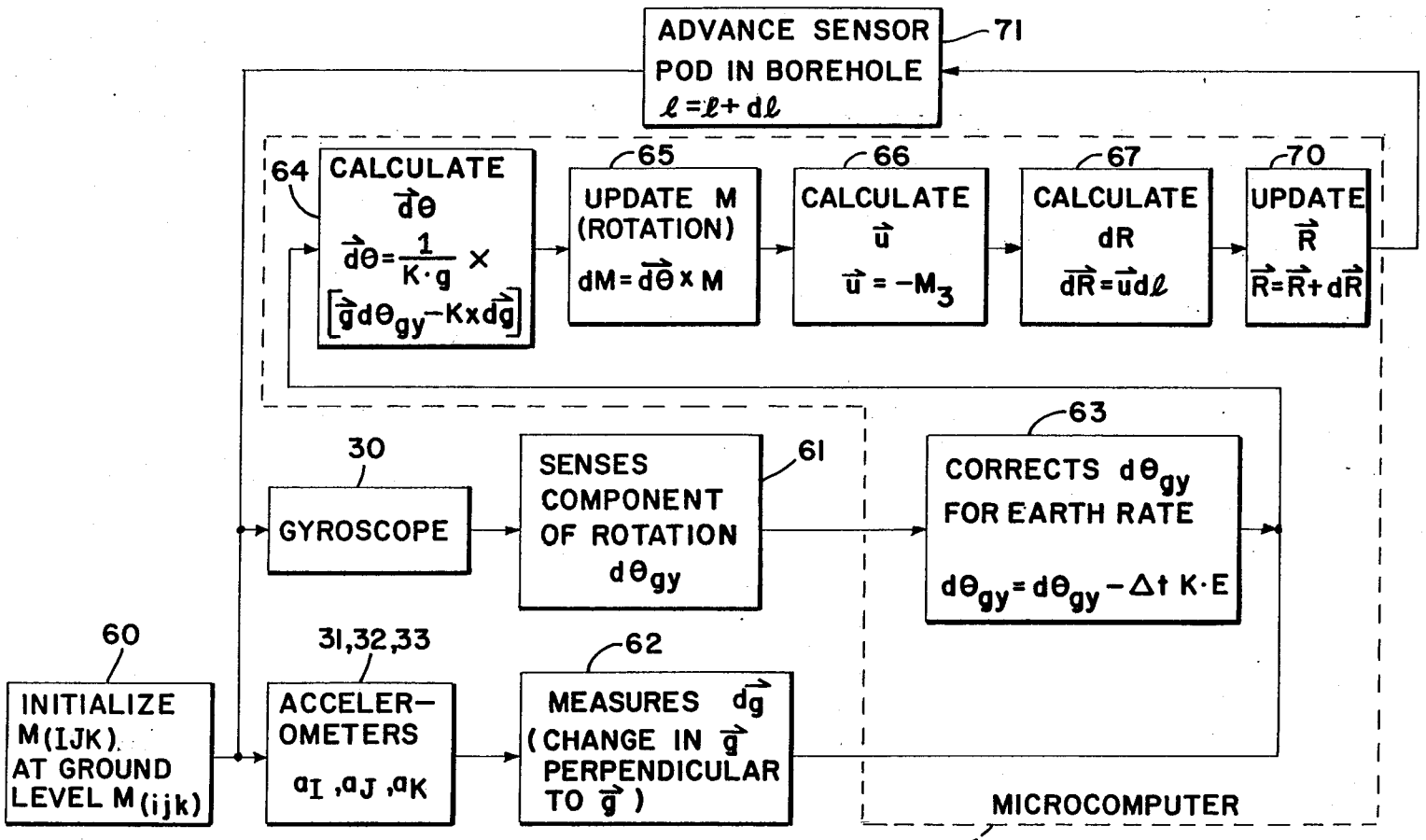
FIG. 4 is a diagram indicating the sequence of operations of bore hole survey apparatus according to the present invention.

The method of operation of the survey apparatus according to the present invention is summarized in FIG. 4. The process begins at the step indicated by reference number 60, with the pod at ground level. The pod is oriented to align its body reference vectors with the Earth reference coordinate system as an initial condition. The apparatus 22 may then be started to lower instrument pod 20 into the bore hole. In general, movement of the pod down the bore hole may cause changes in pod attitude, causing corresponding changes in the outputs of the gyroscope 30 and accelerometers 31, 32, 33. Step 61 symbolically indicates the sensing by the gyroscope of the accumulated increment of rotation of the pod for the increment of travel dl. Similarly, step 62 indicates the measurement of any change in the observed gravity vector due to the change in attitude of the pod.

The rotation component sensed at step 61 is then corrected at step 63 for effects of Earth rate, as previously described, and the accelerometer data and corrected rotation data are used at step 64 to calculate $d\theta$, following which computations are performed for the updating of M, the calculation of $\vec{u}$, and the calculation of $d\vec{r}$, as indicated by steps 65, 66 and 67 in FIG. 4. More complete descriptions of each of these calculations are set forth above in this specification.

Finally, at step 70, the $\vec{R}$ vector is updated by adding the calculated $d\vec{r}$ to the prior $\vec{R}$ value, thus specifying the location of the pod.

At step 71, the pod is advanced further into the bore hole by an amount dl, and l is updated by adding the increment to the previous value of l. The measurement and calculation process is repeated, looping through the steps of FIG. 4 as indicated by arrows, to continuously update the $\vec{R}$ vector at all locations as the pod is lowered into the bore hole.

It should be noted that according to the present invention, the pod can either move in discrete steps down the bore hole, or it can move continuously. The stepwise computation method, as illustrated in FIG. 4, based on increments of distance dl can be implemented even though the pod itself moves continuously down the bore hole. This can be done by taking electronic measurements at intervals as the pod is moving, and calculating and updating between measurements so that it is not necessary to physically stop the movement of the pod between calculation increments, although this can be done if desired. In any case the gyro output must be monitored continuously during movement so as to accumulate $d\theta_{gy}$ for each increment dl.

Steps 63 through 70 represent calculation steps that may best be implemented by a microcomputer, as suggested by broken line 75. As previously mentioned, this microcomputer can be at the surface in computational apparatus 50, or it can be partially or completely implemented in pod 20 along with the sensors.

The calculation and updating of the $\vec{R}$ vector provides an accurate survey of the bore hole at all depths, and this information can be stored, displayed or printed out as may be appropriate for the intended use of the survey data, in accordance with known data handling techniques.

Thus, it will be appreciated from the foregoing description that the present invention provides an improved apparatus and method for simple and accurate bore hole surveys.

What is claimed is:

1. Bore hole survey apparatus, comprising:

an instrumentation pod adapted for travel down a bore hole to be surveyed;

said pod including a rate gyroscope for sensing rotation of the pod substantially about its longitudinal axis along which it travels in the bore hole;

said pod including accelerometer means for sensing the Earth's gravity vector with respect to a frame of reference of the pod;

means for lowering said pod in a bore hole and for measuring increments of said lowering; and computational means connected for receiving signals from said rate gyroscope, said accelerometers and said lowering means, and for calculating therefrom the updated attitude and position of said pod as it is lowered into said bore hole, said computational means being programmed with an algorithm which calculates the updated pod location by performing the steps of:

(a) receiving said signals from said rate gyroscope and calculating therefrom an increment of rotation of the pod around its longitudinal axis ($d\theta gy$);

(b) receiving said signals from said accelerometer means and calculating therefrom an incremental tilt of the gravity vector from the pod frame of reference ($d\vec{g}$);

(c) calculating an incremental rotation of the pod ($d\theta$) using the formula $$d\vec{\theta} = \frac{1}{K \cdot g}\,[\vec{g}\,d\theta gy - \vec{K} \times d\vec{g}];$$

(d) calculating from $d\vec{\theta}$ the updated attitude matrix of the pod and calculating therefrom a unit direction vector ($\vec{u}$) which indicates the direction in inertial space of the longitudinal axis of the pod; and (e) multiplying the unit direction vector by the measured increments of the cable received from said means for lowering and calculating therefrom the updated pod location.

2. Bore hole survey apparatus according to claim 1 wherein said means for lowering is adapted for continuously lowering said pod in said bore hole, and wherein said computational means is adapted for calculating and updating pod attitude and position at intervals as the pod is lowered.

3. Bore hole survey apparatus according to claim 1 wherein said computational means includes means for receiving signals from said rate gyroscope and operative to accumulate increments of rotation of the pod corresponding to increments of lowering of the pod in the bore hole.

4. Bore hole survey apparatus according to claim 1 wherein said accelerometer means comprises three accelerometers positioned within said pod with their sensitive axes along three mutually perpendicular directions.

5. Bore hole survey apparatus according to claim 4 wherein the sensitive axis of one of said accelerometers is aligned with the longitudinal axis of said pod.

6. Bore hole survey apparatus according to claim 1 wherein the sensing axis of said rate gyroscope is aligned with the longitudinal axis of said pod.

7. Bore hole survey apparatus according to claim 1 wherein said computational means is operative to correct sensed rotation by said rate gyroscope for the effects of Earth rotation.

8. A method of surveying a bore hole, comprising the steps of:

lowering by a known increment an instrumentation pod containing a rate gyroscope and accelerometer means into the bore hole to be surveyed;

sensing the Earth's gravity vector and any rotation of the pod for increments of lowering of the pod; and calculating and updating the position of the pod for each increment of lowering by the substeps of:

(a) calculating an increment of rotation of the pod around its longitudinal axis ($d\theta gy$);

(b) calculating the incremental tilt of the gravity vector from the pod frame of reference ($d\vec{g}$);

(c) calculating the incremental rotation of the pod ($d0$); using the formula $$d\vec{\theta} = \frac{1}{K \cdot g}\,[\vec{g}\,d\theta gy - \vec{K} \times d\vec{g}];$$

(d) calculating from $d\theta$ the updated attitude matrix of the pod and calculating therefrom a unit direction vector ($\vec{u}$) which indicates the direction in inertial space of the longitudinal axis of the pod; and (e) multiplying the unit direction vector by the incremental lowering of the cable and calculating therefrom updated position of the pod.

9. The method according to claim 8 including the further step of correcting said sensing of pod rotation for the effects of Earth rotation.

10. The method of claim 8 wherein said step of lowering said pod comprises continuous lowering of the pod and wherein steps of sensing, calculating and updating are performed at intervals as the pod is being lowered.

11. The method of claim 8 further including the step of initializing the pod prior to lowering in the bore hole by aligning the sensitive axes of said accelerometer means with predetermined directions at the surface prior to lowering the pod into the bore hole.

* * * * *